US006914576B1

(12) United States Patent
Sahba

(10) Patent No.: US 6,914,576 B1
(45) Date of Patent: Jul. 5, 2005

(54) MULTI-RESONANT DOUBLE-SIDED HIGH-TEMPERATURE SUPERCONDUCTIVE MAGNETIC DIPOLE ANTENNA

(75) Inventor: Shapur Sahba, Ocean, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 53 days.

(21) Appl. No.: 10/689,920

(22) Filed: Oct. 20, 2003

(Under 37 CFR 1.47)

(51) Int. Cl.[7] ..... H01Q 9/16
(52) U.S. Cl. ..... 343/793; 455/561
(58) Field of Search ..... 343/793, 700 MS, 343/775, 781 CA, 909, 753; 455/561; 333/161

(56) References Cited

U.S. PATENT DOCUMENTS 5,171,733 A * 12/1992 Hu ..... 505/161
5,215,959 A * 6/1993 Van Duzer ..... 505/201
5,472,935 A * 12/1995 Yandrofski et al. ..... 505/210
6,081,235 A * 6/2000 Romanofsky et al. ..... 343/700 MS
2003/0016094 A1 * 1/2003 Kai et al. ..... 333/99 S

* cited by examiner

*Primary Examiner*—Hoang V. Nguyen
*Assistant Examiner*—Huedung X. Cao
(74) *Attorney, Agent, or Firm*—Michael Zelenka; George B. Tereschuk

(57) ABSTRACT

A group of Double-Sided High-$T_c$ Superconducting (HTS) Magnetic-Dipole Micro-Antennas is provided. The multi-resonant double-sided HTS magnetic dipole micro-antenna are fabricated using thin-film ($\tau_{YBCO}\approx 3000$ Å) YBCO material (with $T_c\approx 92$ K). The substrate is a single $LaAlO_3$ crystal (with the loss-tangent of tan $\delta\approx 10^{-5}$, $\epsilon_r\approx 24$) with the thickness of $\tau_{LAO}\approx 508$ $\mu$m. Each antenna is comprised of a combination of co-centric loop and spiral structures, patterned on both sides of the substrate without ground plane. Due to their geometric structures, each antenna demonstrates a multi-resonant characteristic. The comparison between the overall dimensions of the device (22×22 mm$^2$) and variation of the wavelength at resonances indicate a typical ratio of $D/\lambda\approx 10^{-2}$ between the largest loop diameter and the longest wavelength. A multi-resonant double-sided spiral HTS magnetic dipole micro-antenna, a multi-resonant double-sided folded log-periodic HTS magnetic dipole micro-antenna and methods for reducing antenna length with a multi-resonant double-sided HTS magnetic dipole micro-antenna are also provided.

90 Claims, 7 Drawing Sheets

MULTI-RESONANT DOUBLE-SIDED HIGH-TEMPERATURE SUPERCONDUCTIVE MAGNETIC DIPOLE ANTENNA

GOVERNMENT INTEREST

The invention described herein may be manufactured, used, imported, sold, and licensed by or for the Government of the United States of America without the payment to me of any royalty thereon.

FIELD OF THE INVENTION

The invention generally relates to superconducting antennas. In particular, the invention relates to a double-sided high-temperature superconductive magnetic dipole antenna.

BACKGROUND OF THE INVENTION

Several applications of High-Temperature Superconductivity to RF components and systems have been investigated. Currently available device applications and frequency ranges of High-Temperature Superconducting ("HTS")-RF components also indicate a wide variation from the low HF frequencies of the electromagnetic spectrum to much higher satellite communication frequencies. But, those prior art devices suffer from a number of shortcomings, disadvantages and limitations.

Until now, it has not been possible to attain the advantages of low surface loss characteristics and reduced antenna size in available HTS-RF components. Accordingly, there has been a long-felt need for a reduced antenna size with the low surface loss characteristics found in superconducting materials. This invention's multi-resonant double-sided High-$T_c$ Superconducting (HTS) magnetic dipole micro-antenna advantageously provides low surface loss characteristics, reduced antenna size and a high Q value, without suffering from the shortcomings, disadvantages and limitations of prior art devices.

This invention's multi-resonant double-sided HTS magnetic dipole micro-antenna comprises patterned thin-film YBCO layers placed around a $LaAlO_3$ crystal substrate that are shaped to produce strong magnetic coupling between loops on each side of the structure, low loss surface characteristics, circular polarization and multi-resonant characteristics that are not available in the prior art HTS antenna structures. Considering the extreme variations of wavelengths achieved at these frequencies, with $\lambda$ varying between a few centimeters and a few meters and a $10^{-2}\lambda$ diameter, the antenna provides significant low loss surface characteristics in a much-reduced size, without suffering from the shortcomings, disadvantages and limitations of prior art devices.

SUMMARY OF THE INVENTION

It is an object of the present invention to provide a multi-resonant double-sided HTS magnetic dipole micro-antenna with low surface loss characteristics, reduced antenna size and a high Q value.

It is another object of the present invention to provide a multi-resonant double-sided HTS spiraled magnetic dipole micro-antenna with low surface loss characteristics, reduced antenna size and a high Q value.

It is yet another object of the present invention to provide a multi-resonant double-sided HTS folded log-periodic magnetic dipole micro-antenna with low surface loss characteristics, reduced antenna size a high Q value.

These and other objects and advantages can now attained by this invention's multi-resonant double-sided HTS magnetic dipole micro-antenna, without suffering from any of the disadvantages, shortcomings and limitations of prior art antenna structures. The present invention provides a multi-resonant double-sided HTS magnetic dipole micro-antenna comprising two patterned thin-film YBCO layers positioned on both sides of an $LaAlO_3$ crystal substrate that are shaped into different rounded configurations to produce strong magnetic coupling between the loops on each side, low loss surface characteristics, circular polarization and multi-resonant characteristics with frequencies as low as 200 MHz and as high as a few GHz. This antenna's curvilinear shapes, loops or spirals advantageously provide a multi-resonant characteristic that is not available in the prior art HTS antenna structures and a much shorter antenna diameter of about $10^{-2}\lambda$. In one embodiment, this invention's multi-resonant double-sided magnetic dipole micro-antenna comprises a number of Archimedean spirals patterned on both sides of the LAO substrate. In another embodiment, this invention's double-sided magnetic dipole micro-antenna comprises a folded log periodic structure patterned on both sides of the LAO substrate. The present invention also encompasses multi-resonant RF radiating elements with fundamental modes and methods for reducing antenna size and providing low loss surface characteristics, circular polarization and multi-resonant characteristics in HTS magnetic dipoles.

DETAILED DESCRIPTION OF THE DRAWINGS

Figure 1:
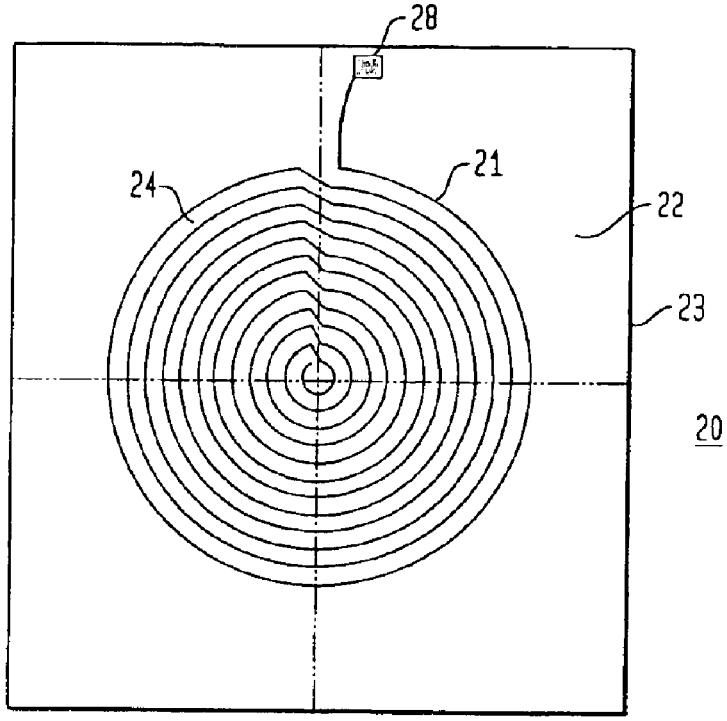
FIG. 1 is a top view of the multi-resonant double-sided spiral HTS magnetic dipole micro-antenna of the present invention showing a spiral pattern on a top surface of the LAO substrate.

Referring now to the drawings, FIG. 1 is a top view of the multi-resonant double-sided spiral HTS magnetic dipole micro-antenna 20 of the present invention, comprising a first YBCO thin-film 21 patterned on a top surface 22 of an LAO substrate 23. The first YBCO thin-film 21 is patterned in a curvilinear shape with a plurality of loops to form a first means for YBCO radiation 24 with a spiral pattern. The first YBCO radiating means 24 generates a first magnetic flux within the spiral loops and is configured so that at any half-cycle the current-flow in one side of the spiral is in phase with the other side of the spiral from another YBCO radiating means on a bottom surface of the LAO substrate 23, not shown in this drawing. The LAO substrate 23 does not have a ground plane. The first YBCO radiating means 24 is connected to a contact pad 28.

Figure 2:
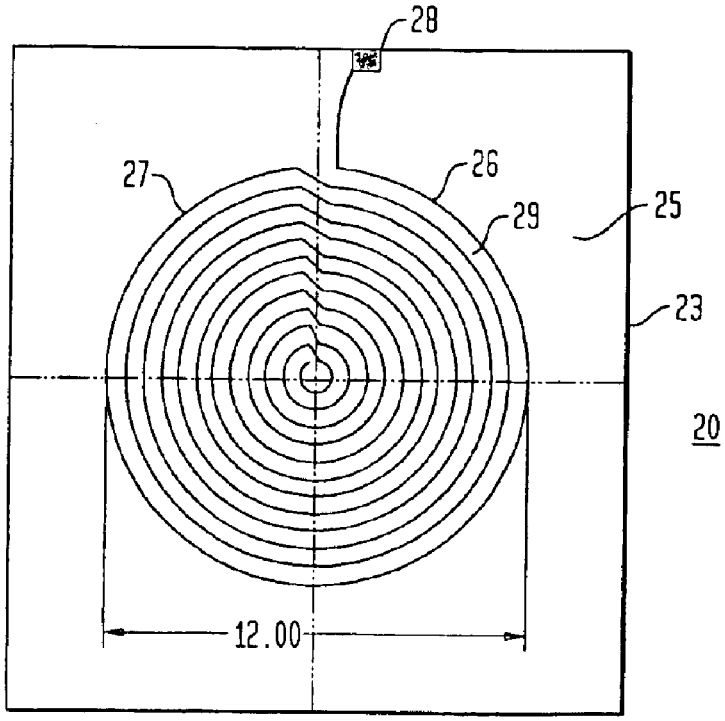
FIG. 2 is a bottom view of the multi-resonant double-sided spiral HTS magnetic dipole micro-antenna of the present invention showing a spiral pattern on the bottom surface of the LAO substrate.

FIG. 2 is a bottom view of the multi-resonant double-sided spiral HTS magnetic dipole micro-antenna 20 of the present invention, employing like numerals for similar structures, comprising a second YBCO thin-film 26 patterned on a bottom surface 25 of an LAO substrate 23 to form a second means for YBCO radiation 27. The second YBCO radiating means 27 being deposited on bottom surface 25 of LAO substrate 23 and the FIG. 1 top surface arrangement provides stacked YBCO-LAO-YBCO layers. The second YBCO radiating means 27 is identical to the first YBCO radiating means 24 and generates a second magnetic flux within the spiral loops and is configured so that at any half-cycle the current-flow in one side of the spiral is in phase with the other side of the spiral from the FIG. 1 first YBCO radiating means 24 on the top surface of the LAO substrate 23. The second YBCO radiating means 24 is also connected to contact pad 28. FIG. 2 also depicts a representative 12.0 mm width dimension for the second YBCO radiating means 26. The contact pad 28 could measure 1 mm high and 1 mm wide, and the second YBCO radiating means 27 can be composed with a line width of 0.1 mm.

The unique YBCO spiral pattern 24 in this embodiment affords multi-resonant properties because of the lack of smooth transition between adjacent spiral loops and the discontinuity between the FIG. 1 first YBCO radiating means 24 and the FIG. 2 second YBCO radiation means 27. Further, both the FIG. 1 first YBCO radiating means 24 and the FIG. 2 second YBCO radiation means 27 also provide an advantageous circular polarization on each surface because of the circular current path created by the spiral pattern. The multi-resonant double-sided spiral HTS magnetic dipole micro-antenna 20 of the present invention also provides the low ohmic loss that is characteristic of HTS devices. In a preferred embodiment, the LAO substrate 23 was a single $LaAlO_3$ crystal with a loss-tangent of tan $\delta \approx 10^{-5}$, $\epsilon_r \approx 24$ and a thickness of about 508 $\mu$m. In the preferred embodiment, the YBCO thin film 21 was about 3000 Å thick with a $T_c$ of about 92° K, a width of 100 $\mu$m and inner and outer radii of 450 $\mu$m and 5950 $\mu$m, respectively. In the preferred embodiment, the FIG. 1 first YBCO radiating means 24 and the FIG. 2 second YBCO radiation means 27 in the shape of an Archimedean spiral can be configured with 12 turns of the YBCO thin films 21 and 26, respectively.

To better appreciate the operation and features of this invention's multi-resonant double-sided spiral HTS magnetic dipole micro-antenna 20, several theoretical concepts underlying its operation should be explained. These theoretical concepts are the loop theory for the magnetic-dipole antenna, inductive coupling between the top and bottom surfaces 22 and 25, respectively, propagation of electromagnetic waves in space and far-field and the effects of using HTS materials in the composition of these devices.

In magnetic-dipole antennas, for an n-turn loop carrying a time-varying current, I, one can derive a fictitious magnetic-dipole with current $I_m$, having a length of $\Delta l$, as follows:

$$I_m = jn\mu\omega I A_L/\Delta l \tag{1}$$

where the $\omega$ is the angular frequency, $A_L$ is the loop area, and $\mu$ is the permeability of the medium.

Three regions surrounding the magnetic-dipole are the near-field reactive region, near-field radiation region and the far-field radiation region. In most antenna analyses, the boundary between the near-field radiation region and the far-field radiation region is usually given as directly related to the wavelength as $r \sim \lambda/2\pi$, and the area beyond that point is considered the far-field radiation region, which is the region of interest here. The reactive region, however, shows strong magnetic coupling between the first YBCO radiation means 24 and the second YBCO radiation means 27. To show inductive coupling, one could utilize the magnetic dipole moment-m of an n-turn loop carrying the retarded current I, given by:

$$I = I_0 \operatorname{Sin}[\omega(t - r/c)] \tag{2}$$

$$m_0 = \mu_0 n I_0 A_L \tag{3}$$

In the multi-resonant double-sided spiral HTS magnetic dipole micro-antenna 20 of the present invention, the magnitude of the magnetic-dipole moment is directly related to the magnetic flux, where $\phi = m_0/l$, with l being the length of the loop, which is generated by one spiral of the first YBCO radiation means 24 and is shared by the other spiral of the second YBCO radiation means 27. Further analysis shows that inductive coupling between the top 22 and bottom 25 surfaces, or vice versa, plays the most important role in the radiation of the double-sided antennae. Using the general far-field radiation equations of the loop antenna of any size, given as:

$$E_\Phi = \{60\pi I C_\lambda J_l(C_\lambda \operatorname{Sin}(\theta))\}/r \tag{4}$$

$$H_\theta = \{I C_\lambda J_l(C_\lambda \operatorname{Sin}(\theta))\}/2r \tag{5}$$

where $J_l$ is the Bessel function of first-kind, for n=1 in a general summation form of $J_n(C_\lambda \operatorname{Sin}\theta) = \Sigma\{(-1)^s/[s!(s+n)!]\}\{(C_\lambda \operatorname{Sin}\theta)/2\}^{2s+n}$ (s varying between 0-$\infty$), and $C_\lambda$ is the circumference of the loop in terms of wavelength, where $C_\lambda = 2\pi a/\lambda$, for a being the radius of loop.

These general equations can further be simplified, by taking the Bessel function to its first-order approximation, when considering the specific case of small loop structure. For the loop area of $A < \lambda^2/100$, and $C_\lambda < 1/3$ case these fields are:

$$E_\Phi = \{120\pi^2 I A \operatorname{Sin}\theta\}/r\lambda^2 \tag{6}$$

$$H_\theta = \{\pi I A \operatorname{Sin}\theta\}/r\lambda^2 \tag{7}$$

One observed advantage of this invention's double-sided antenna structure is platform independence because coupling between the antenna and its surroundings has been greatly reduced, if not completely eliminated. Under resonance the top and bottom reactive components are strongly coupled with each other, instead of the typical coupling with the nearby structures, and this strong coupling could prove to be extremely useful when cross talk and co-site interference are of concern.

The HTS materials selected for this invention's multi-resonant double-sided HTS magnetic dipole micro-antenna exhibit a number of significant advantages and these beneficial effects are more pronounced when the ohmic losses and the superconductive currents are considered in the operation of the antenna. The most remarkable effect is that small ohmic losses of the superconductive antenna that translate into an overall increase in the radiation efficiency, $\eta_{radiation}$, according to the equation:

$$\eta_{radiation}=R_r/(R_{loss}+R_r) \tag{8}$$

where for a n-turn spiral, the $R_r \approx 31200\ n^2[A/\lambda^2]^2$, and $R_{loss}$ are the radiation and ohmic loss resistance values, respectively. HTS materials reduce the loss resistance, which results in higher values for radiation efficiency and significantly improved antenna performance.

As expected, the values of the loss resistance components cause the ohmic losses. Such losses are minimized, if not eliminated, by using an HTS conductor such as YBCO. Those skilled in the art will readily appreciate that a superconductor's surface impedance is a strong function of the penetration depth, frequency, and normal-state conductivity, $\sigma_n$, of the materials, given by:

$$\sigma=\sigma_1-j\sigma_2=\sigma_n(T/T_c)^4-j[1/(\mu_0\omega\lambda_L^2)] \tag{9}$$

$$Z_s=R_s+jX_s \tag{10}$$

$$R_s=\tfrac{1}{2}\{\omega^2\mu_0^2\lambda_L^3\sigma_1[\mathrm{Cot}\ h(\tau/\lambda_L)+(\tau/\lambda_L)(1/[\mathrm{Sin}\ h^2(\tau/\lambda_L)])\} \tag{11}$$

$$X_s=\omega\mu_0\lambda_L\ \mathrm{Cot}\ h(\tau/\lambda_L) \tag{12}$$

Thus, using the two-fluid model, and considering full-wave analysis by using the propagation constant instead of quasi-static approach, the loss and phase constants are given as follows:

$$\gamma=\alpha+j\beta \tag{13}$$

$$\alpha = \{(\mu_0\varepsilon_0\varepsilon_{eff.})^{1/2}\}\cdot\{\omega^2\mu_0\lambda_L^3\sigma_1[\mathrm{Coth}(\tau_1/\lambda_L)+\tau_1/[\lambda_L\mathrm{Sinh}^2(\tau_1/\lambda_L)]\}/\{4d[\mu_{eff.}+(\lambda_L/d)(\mathrm{Coth}(\tau_1/\lambda_L))]^{1/2}\} \tag{14}$$

$$\beta=\{(\mu_0\epsilon_0\epsilon_{eff.})^{1/2}\}\{\omega[\mu_{eff.}+(\lambda_L/d)\mathrm{Cot}\ h(\tau_1/\lambda_L)]^{1/2}\}\epsilon_{eff.}=\{[(\epsilon_r+1)/2]+[(\epsilon_r-1)/2][1/(1+12d/w)^{1/2}]+0.04[1-w/d]^2\},\ \text{for } w\leq d \tag{15}$$

$$\mu_{eff.}=\{2\mu_r/(1+\mu_r)+(1-\mu_r)/[1+10d/w]^{1/2}\} \tag{16}$$

where $\sigma$ is the complex conductivity, $\tau$ is the line-thickness, w is the microstrip line-width, d is the substrate thickness, $\epsilon_{eef.}$ and $\mu_{eff.}$ are the relative permittivity and relative permeability constants, respectively. The inherent HTS parameter called the temperature-dependent London penetration-depth is:

$$\lambda_L(T)=\lambda_0/(\sqrt{[1-(T/T_c)^4]}) \tag{17}$$

where is $\lambda_0$ the same at zero degree Kelvin, and $R_s$ and $X_s$ are the surface resistance and reactance, respectively. Thus it is clear that surface resistance values determine the antenna's ohmic losses.

Figure 3:
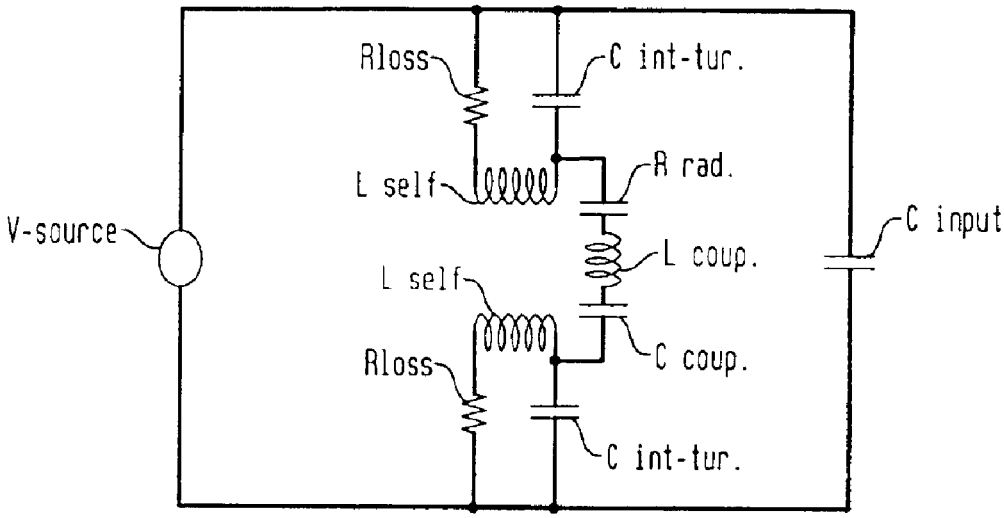
FIG. 3 an equivalent lumped-element circuit diagram at a specific frequency.

Another important advantage is platform independence between the antenna and the ground. Platform independence can be demonstrated by considering the equivalent lumped-element circuit diagram depicted in FIG. 3 and the FIGS. 4 and 5 block diagrams. Referring now to FIG. 3, there is depicted an equivalent lumped-element circuit diagram at a specific frequency in which coupling inductance, which is the result of mutual inductance, is excited when mutual resonance occurs. It should be noted that this resonant frequency is different, and its value is smaller, than that of individual spiral inductors.

Figure 4:
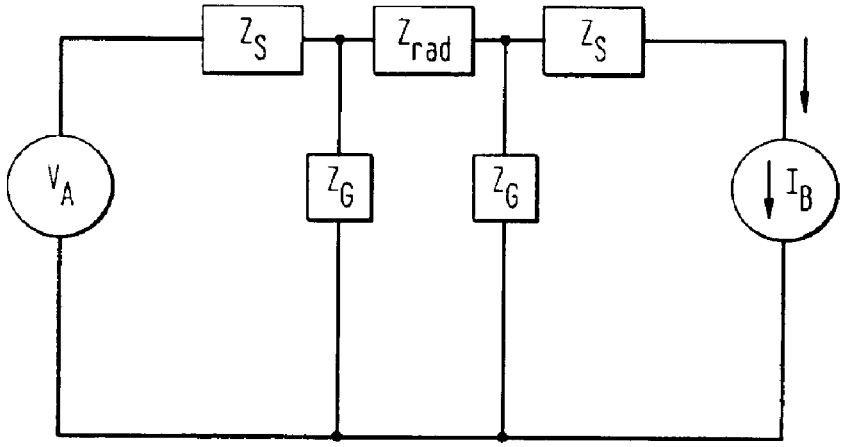
FIG. 4 is a block diagram of the two spiral radiators at the $n^{th}$ half-cycle.

FIG. 4 is a block diagram of the two spiral YBCO radiating means 24 and 27 at the $n^{th}$ half-cycle. FIG. 4 illustrates how at a half cycle, voltage in the A side, or top surface's FIG. 1 first YBCO radiating means 24, travels in one direction and the current in B side, or bottom surface's FIG. 2 second YBCO radiation means 27, travels in the opposite direction.

Figure 5:
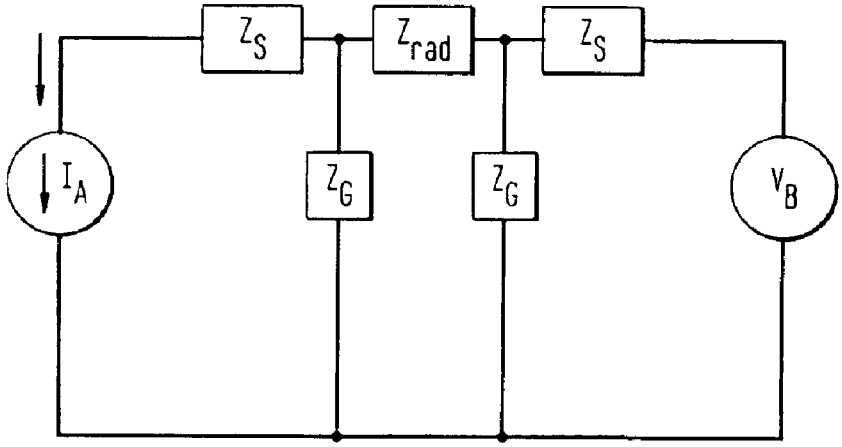
FIG. 5 is a block diagram of the two spiral radiators at the $n+1^{st}$ half-cycle.

FIG. 5 is a block diagram of the two spiral YBCO radiating means 24 and 27 at the $n+1^{st}$ half-cycle. FIG. 5 illustrates how at n+first half-cycle, the voltage in the B side, or bottom surface's FIG. 2 second YBCO radiation means 27, travels in one direction, while the current in A side, or top surface's FIG. 1 first YBCO radiating means 24, travels in the opposite direction. In both FIGS. 4 and 5, each individual spiral YBCO radiating means 24 and 27 is treated as an individual radiator. Therefore at any half-cycle, the voltage in one spiral results in current flow in the other. The following set of linear equations represent the linear relation between the currents and voltages at two ports of the antenna:

$$\begin{vmatrix} v_A \\ i_A \end{vmatrix} \equiv \begin{vmatrix} A & B \\ C & D \end{vmatrix}\begin{vmatrix} v_B \\ i_B \end{vmatrix}$$

$$\begin{aligned} A&=[Z_SZ_{rad.}+Z_SZ_G+Z_G(Z_S+Z_G)]/Z_G^2 \\ B&=\{2[Z_S(Z_{rad.}+2Z_G)+Z_{rad.}Z_G]/[Z_{rad.}+2Z_G]\}+\{[Z_S(Z_{rad.}+2Z_G)+Z_{rad.}Z_G]^2/[Z_G^2(Z_{rad.}+2Z_G)]\} \\ C&=(Z_{rad.}+2Z_G)/Z_G^2 \\ D&=Z_SZ_{rad.}+Z_{rad.}Z_G+Z_GZ_S+Z_G(Z_S+Z_G)]/Z_G^2 \end{aligned} \tag{18}$$

where, $Z_S$ is the impedance of each spiral, $Z_{rad.}$ is the radiation impedance between the two spirals, and is due to the coupling between them, and finally $Z_G$ is the fictitious impedance between each spiral and the nearest ground structures. Without a direct electric contact between the antenna ends and any ground, such as the earth or a system ground, the latter impedance, $Z_G$, is imaginary, or is open and extremely high and near infinity. Further, it also is noted that when strong coupling between the top and bottom surfaces 22 and 25, respectively, takes place even the smallest current will not flow between the spirals and the ground. However, this impedance is noted for its circuit values.

Referring back to FIG. 3 now, the equivalent values of the $Z_S$, $Z_{rad.}$ are obtained as:

$$Z_S=[R_l+j\omega L_0]/[1-\omega^2L_0C_0+j\omega R_lC_0] \tag{19}$$

$$Z_{rad.}=R_{rad.}+j(\omega L_{coup.}-1/[\omega C_{coup.}]) \tag{20}$$

where $R_l$ is the spiral ohmic loss, $L_0$ is the self inductance of each of the spirals and $C_0$ is the inter-turn self capacitance of the spiral. The numerical values of the above lumped-elements can be determined by using full-wave analysis and considering their geometric configurations given by these formulas:

$$L_0=(5.553\times10^{-3})\{n^2[A_o+A_i+2(A_oA_i)^{1/2}]/[15A_o-7A_i]\}\ \text{(nH)} \tag{21}$$

$$C_0=7\times10^{-5}(A_o/\pi)^{1/2}+0.06\ \text{(pF)} \tag{22}$$

$$R_f=\{[\pi n R_s]/W\}\{[A_o/(4\pi)]^{1/2}+[A_i/(4\pi)]^{1/2}\}\ (\Omega) \quad (23)$$

$$L_{coup.}\equiv L_m\approx k\,L_0,\ \text{(mutual or coupling inductance in nH)} \quad (24)$$

$$C_{coup.}\equiv C_m\approx\epsilon_0\epsilon_{eff.}[(A_o-A_i)/d_{eff.}],\ \text{(mutual or coupling capacitance in pF)} \quad (25)$$

where, for an n-turn spiral, $A_o$ and $A_i$ are the outer and inner areas of the individual spiral, respectively, W is the line-width, $\epsilon_{eff.}$ is the effective relative permittivity and $d_{eff.}$ is the effective substrate thickness ($d_{eff.}\approx d_{subst.}+2\lambda_L$), with all dimensions given in micrometers ($\mu$m). Also the value of the coefficient of mutual inductance is found to be k≈1.4946 for frequencies of less than about 500 MHz.

Figure 6A:
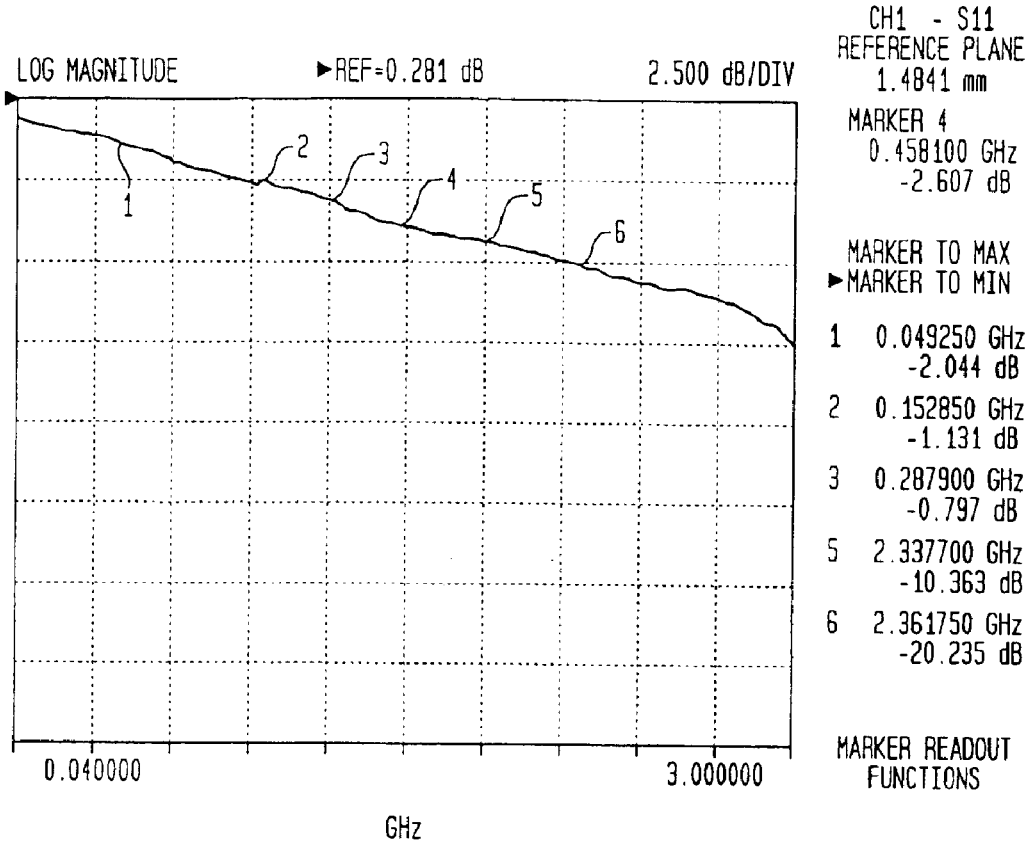
FIG. 6A is a graph depicting the radiation pattern of multi-resonant double-sided spiral HTS magnetic dipole micro-antenna of the present invention at room temperature.
Figure 6B:
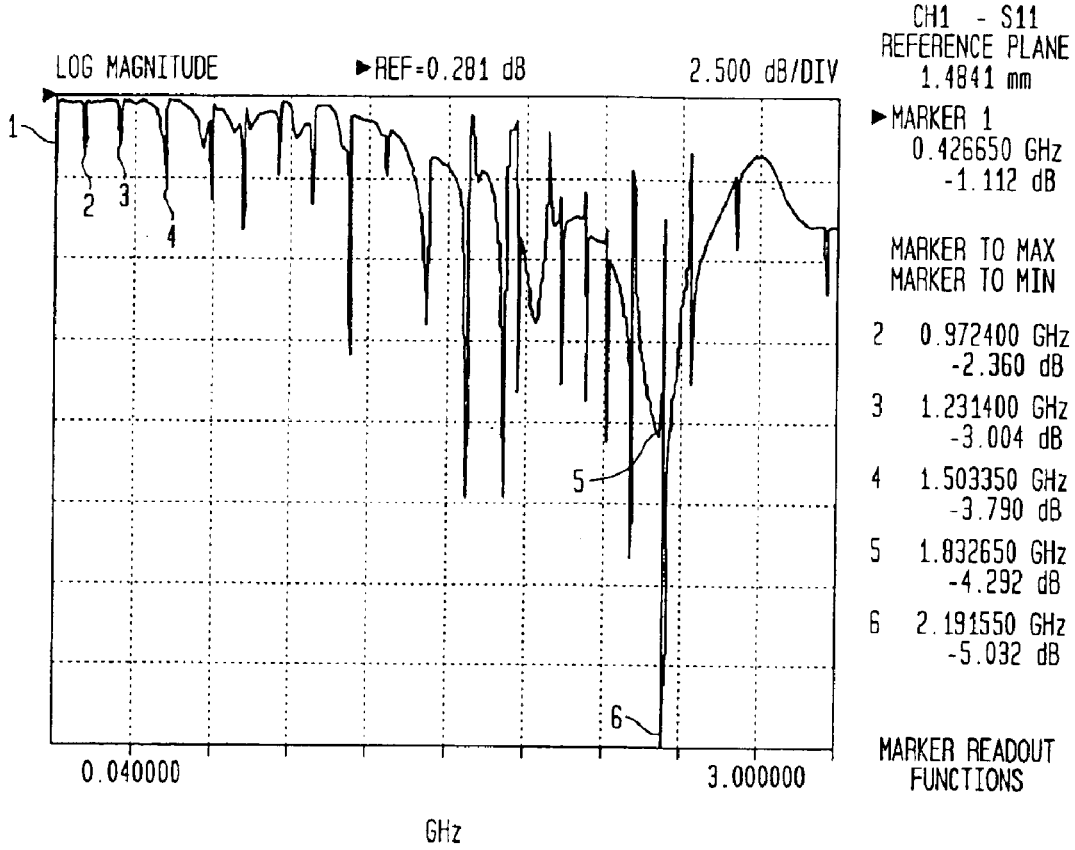
FIG. 6B is a graph depicting the radiation pattern of multi-resonant double-sided spiral HTS magnetic dipole micro-antenna of the present invention at 77 Kelvin.

FIGS. 6A and 6B are graphs depicting the radiation pattern of multi-resonant double-sided spiral HTS magnetic dipole micro-antenna at room temperature and at 77 Kelvin. The radiation patterns were measured during testing and characterization in a Styrofoam Dewar container, filled with liquid nitrogen $LN_2$ to achieve an operational temperature of 77 K and modified to allow the semi-rigid coaxial feed line be connected to the antennae. Each antenna was connected to the coaxial line by using a 50 Ω microwave connector. The FIG. 6A graph depicts the radiation pattern at room temperature graph and the FIG. 6B graph depicts the radiation pattern at 77 Kelvin.

The two basic observed modes of radiation are the axial and radial. In the case of axial mode, it radiates in the direction of the spiral axis in both directions and a narrow bandwidth is detectable. In the case of the radial mode, a typical donut-shaped radiation pattern was observed, except for the area of the feed terminal.

Figure 7:
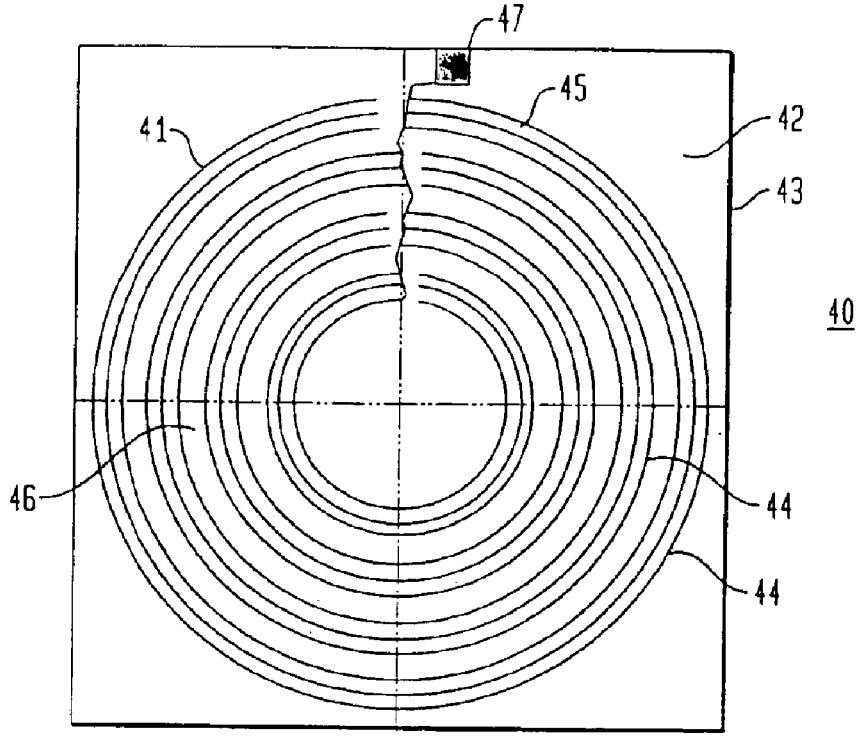
FIG. 7 is a top view of the folded log-periodic multi-resonant double-sided HTS magnetic dipole micro-antenna of the present invention patterned on both YBCO layers.

The present invention also includes a folded log-periodic structure embodiment. Referring now to the drawings, FIG. 7 is a top view of the multi-resonant double-sided folded log-periodic HTS magnetic dipole micro-antenna 40 of the present invention, comprising a series of first YBCO thin-films 41 patterned on a top surface 42 of an LAO substrate 43. The first YBCO thin-films 41 are patterned to a form a first means for YBCO radiation 44 further comprising groups of triple concentric rings arranged in top ring clusters with a ring gap 45 separating the top concentric rings in each cluster, and the top ring clusters being separated from each other by a top cluster gap 46. The first YBCO radiating means 44 generates a first magnetic flux within the clusters' triple ring structure and is configured so that at any half-cycle the current-flow in one side of the triple ring structure is in phase with the other side of the triple ring structure from another YBCO radiating means on a bottom LAO substrate, not shown in this drawing. The LAO substrate 43 does not have a ground plane. The first YBCO radiation means 44 is connected to a contact pad 47.

Figure 8:
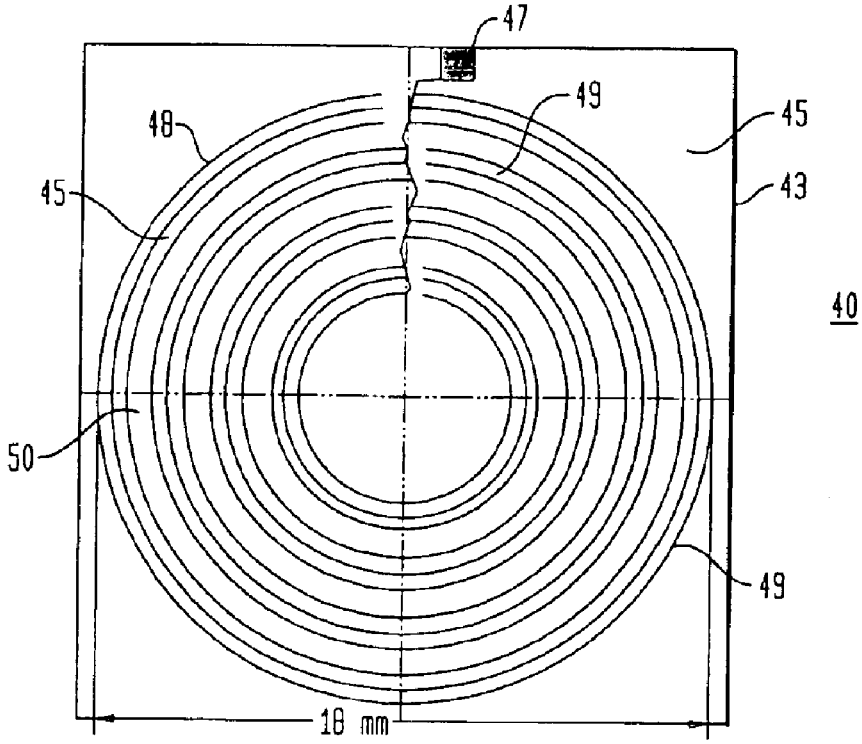
FIG. 8 is a bottom view of the folded log-periodic multi-resonant double-sided HTS magnetic dipole micro-antenna of the present invention patterned on both YBCO layers.

FIG. 8 is a bottom view of the multi-resonant double-sided folded log-periodic HTS magnetic dipole micro-antenna 40 of the present invention, employing like numerals for similar structures, comprising a second YBCO thin-film 48 patterned on a bottom surface 45 of LAO substrate 43 to form a second means for YBCO radiation 49. As in the spiral embodiment, the second YBCO radiating means 49 deposited on the bottom surface 45 of the LAO substrate 43 and the FIG. 7 top surface arrangement provides stacked YBCO-LAO-YBCO layers. The second YBCO radiating means 49 is identical to the first YBCO radiating means 44. The second YBCO radiating means 49 further comprising groups of triple concentric rings arranged in bottom ring clusters with a ring gap 45 separating the bottom concentric rings in each cluster, and the bottom ring clusters being separated from each other by a bottom cluster gap 50. The second YBCO radiation means 49 is connected to a contact pad 47. FIG. 8 also depicts a representative 18.0 mm width dimension for the second YBCO radiating means 49. The contact pad 47 could measure 1 mm high and 1 mm wide, and the second YBCO radiating means 49 can be composed with a line width of 0.1 mm. The dimensions of the ring gap 45 and bottom cluster gap 49 may be varied as needed.

The unique YBCO triple ring cluster structure in this embodiment affords a multi-resonant characteristic because of the discontinuity between the FIG. 7 first YBCO radiating means 44 and the FIG. 8 second YBCO radiation means 49. Additionally, both the FIG. 7 first YBCO radiating means 44 and the FIG. 8 second YBCO radiation means 49 also provide an advantageous circular polarization on each surface because of the circular current path created by the triple ring cluster pattern. The multi-resonant double-sided folded log-periodic HTS magnetic dipole micro-antenna 40 of the present invention also provides the low ohmic loss that is characteristic of HTS devices. The FIG. 7 first YBCO radiating means 44 and the FIG. 8 second YBCO radiation means 49 in this embodiment are configured with 12 turns of the YBCO thin films 41 and 48, respectively.

Figure 9A:
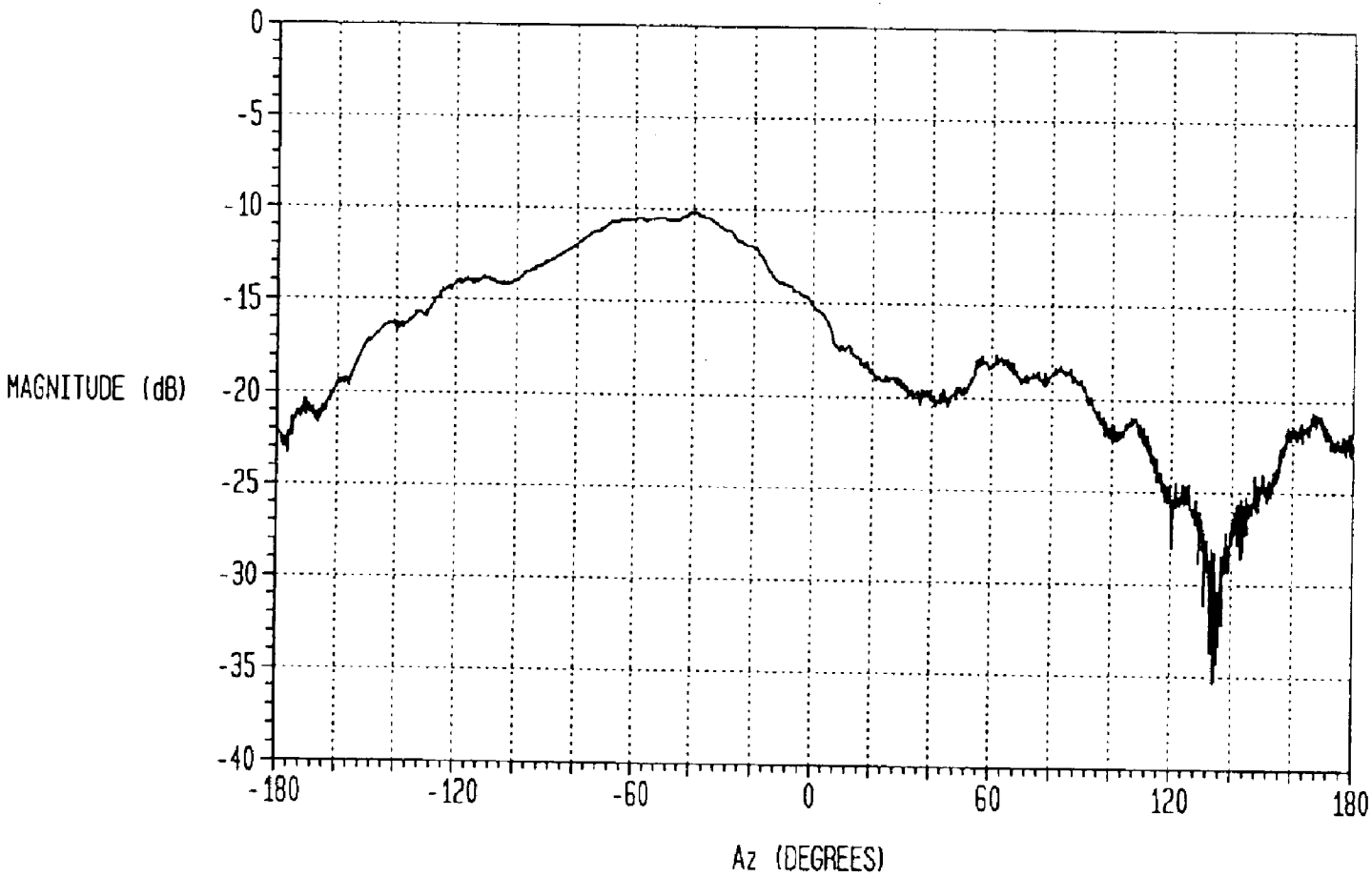
FIG. 9A is a graph depicting the radiation pattern of multi-resonant double-sided folded log-periodic HTS magnetic dipole micro-antenna of the present invention at room temperature.
Figure 9B:
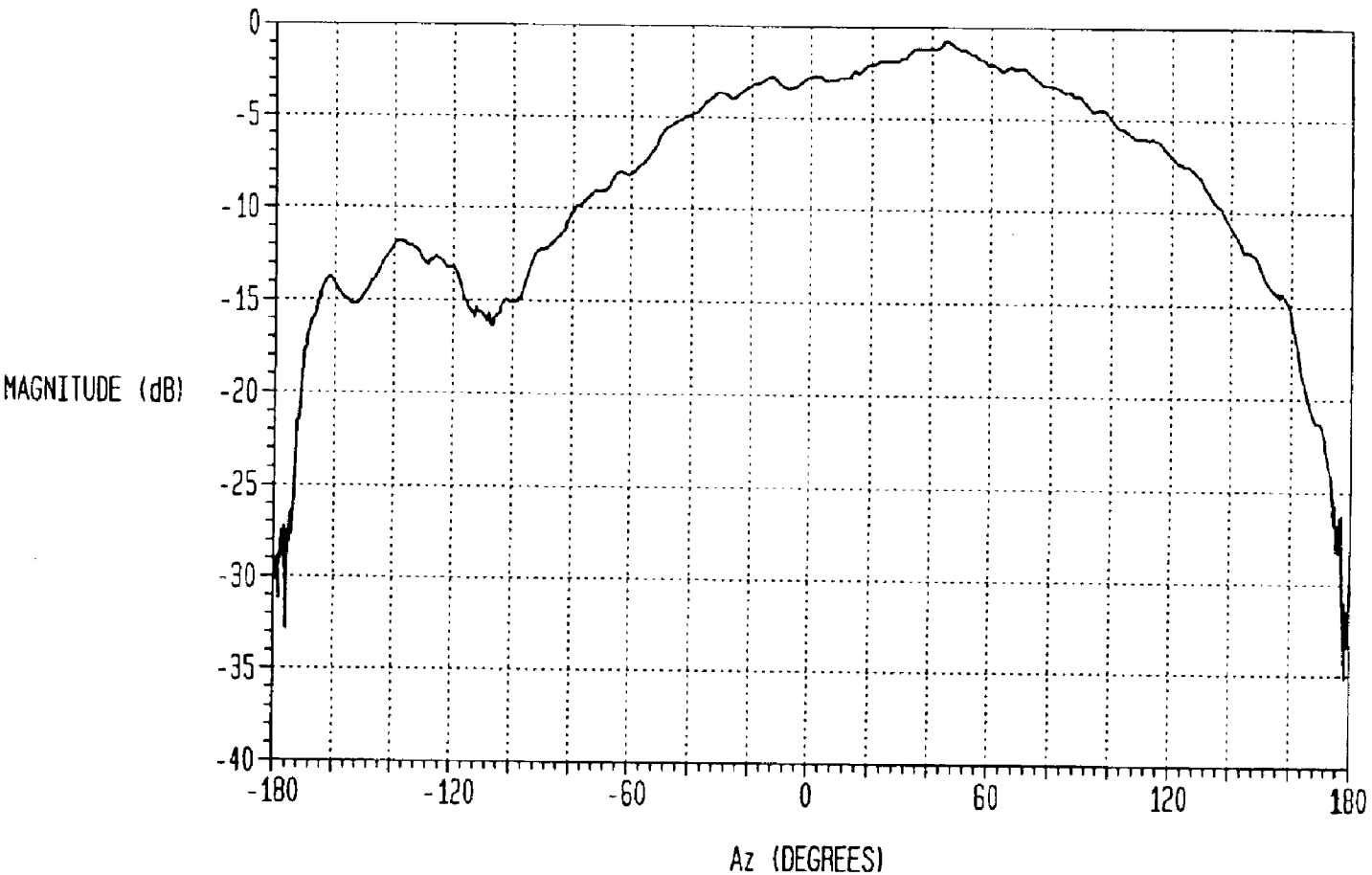
FIG. 9B is a graph depicting the radiation pattern of multi-resonant double-sided folded log-periodic HTS magnetic dipole micro-antenna of the present invention at 77 Kelvin.

FIGS. 9A and 9B are graphs depicting the radiation pattern of multi-resonant double-sided folded log-periodic HTS magnetic dipole micro-antenna 40 of the present invention at room temperature and at 77 Kelvin. The FIG. 9A graph depicts the radiation pattern at room temperature graph and the FIG. 9B graph depicts the radiation pattern at 77 Kelvin.

The present invention also contemplates numerous other variations, modifications and applications beside the double-sided spiral HTS magnetic dipole micro-antenna and multi-resonant double-sided folded log-periodic HTS magnetic dipole micro-antenna, as well as methods for reducing antenna length with a multi-resonant double-sided HTS magnetic dipole micro-antenna.

Referring back to FIGS. 1 and 2, the present invention also includes a method for reducing antenna length with a multi-resonant double-sided HTS magnetic dipole micro-antenna, comprising the steps of depositing a first YBCO thin-film 21 on a top surface 22 of an LAO substrate 23, depositing a second YBCO thin-film 26 on a bottom surface 25 of LAO substrate 23, forming a first means for YBCO radiation 24 by patterning the first YBCO thin-film 21 on the top surface 22 into a first curvilinear shape and forming a second means for YBCO radiation 27 by patterning the second YBCO thin-film 26 on the bottom surface 25 in a second curvilinear shape. The steps of the method further comprise generating a first magnetic flux within the first YBCO radiating means 24, generating a second magnetic flux within the second YBCO radiation means 27, generating an inductive coupling by a magnetic dipole moment from the first YBCO radiation means 24 and the second YBCO radiation means 27, configuring the first YBCO radiating means 24 so that at any one of a plurality half-cycles a first current flow is in phase with a second current flow in the second YBCO radiating means 27, generating a circular polarization radiation pattern in the first curvilinear shape and the second curvilinear shape, causing a plurality of multi-resonant properties by a discontinuity between the first YBCO radiation means 24 and the second YBCO radiation means 27, providing a decreased surface impedance due to the interaction of the first YBCO radiating means 24, the second YBCO radiating means 27 and the LAO substrate 23 and permitting a reduced antenna size with an increased antenna efficiency due to the inductive coupling, the first current flow and the second current flow being in phase, the decreased surface impedance, the circular polarization radiation pattern and the plurality of multi-resonant properties. The first curvilinear and second curvilinear shapes can be a plurality of spiral loops, a multiple turn Archimedean spiral or a series of concentric rings.

It is to be further understood that other features and modifications to the foregoing detailed description are within the contemplation of the present invention, which is not limited by this detailed description. Those skilled in the art will readily appreciate that any number of configurations of the present invention and numerous modifications and combinations of materials, components, stacking arrangements and dimensions can achieve the results described herein, without departing from the spirit and scope of this invention. Accordingly, the present invention should not be limited by the foregoing description, but only by the appended claims.

What I claim is:

1. A multi-resonant double-sided HTS magnetic dipole micro-antenna, comprising:

a first YBCO thin-film is patterned into a first curvilinear shape to provide a first means for YBCO radiation on a top surface of an LAO substrate;

a second YBCO thin-film is patterned in a second curvilinear shape to provide a second means for YBCO radiation on a bottom surface of said LAO substrate;

said first YBCO radiating means generating a first magnetic flux;

said second YBCO radiation means generating a second magnetic flux;

said first YBCO radiation means and said second YBCO radiation means generating an inductive coupling by a magnetic dipole moment;

said first YBCO radiating means being configured so that at any one of a plurality half-cycles a first current flow is in phase with a second current flow in said second YBCO radiating means;

said first curvilinear shape and said second curvilinear shape each generate a circular polarization radiation pattern;

a discontinuity between said first YBCO radiation means and said second YBCO radiation means causes a plurality of multi-resonant properties;

said first YBCO radiation means, said second YBCO radiation means and said LAO substrate provide a decreased surface impedance; and said inductive coupling, said first current flow and said second current flow being in phase, said decreased surface impedance, said circular polarization radiation pattern and said plurality of multi-resonant properties permit a reduced antenna size with an increased antenna efficiency.

2. The multi-resonant double-sided HTS magnetic dipole micro-antenna, as recited in claim 1, further comprising said first YBCO thin-film being deposited to pattern said first curvilinear shape.

3. The multi-resonant double-sided HTS magnetic dipole micro-antenna, as recited in claim 2, further comprising said second YBCO thin-film being deposited to pattern said second curvilinear shape.

4. The multi-resonant double-sided HTS magnetic dipole micro-antenna, as recited in claim 3, further comprising said second YBCO radiating means being configured so that at any one of the plurality of half-cycles said second current flow is in phase with said first current flow in said first YBCO radiating means.

5. The multi-resonant double-sided HTS magnetic dipole micro-antenna, as recited in claim 4, further comprising said first magnetic flux being generated within said first curvilinear shape.

6. The multi-resonant double-sided HTS magnetic dipole micro-antenna, as recited in claim 5, further comprising and said second magnetic flux being generated within said second curvilinear shape.

7. The multi-resonant double-sided HTS magnetic dipole micro-antenna, as recited in claim 6, further comprising said magnetic dipole moment having a given magnitude.

8. The multi-resonant double-sided HTS magnetic dipole micro-antenna, as recited in claim 7, farther comprising said given magnitude being proportional to said first magnetic flux.

9. The multi-resonant double-sided HTS magnetic dipole micro-antenna, as recited in claim 8, further comprising said given magnitude being proportional to said second magnetic flux.

10. The multi-resonant double-sided HTS magnetic dipole micro-antenna, as recited in claim 9, further comprising said decreased surface impedance being a superconductive property based on a temperature-dependent London penetration depth.

11. The multi-resonant double-sided HTS magnetic dipole micro-antenna, as recited in claim 10, further comprising:

a voltage at any one of the plurality of half-cycles of said first YBCO radiating means results in a current flow in said second YBCO radiating means forming a radiation impedance, $Z_{rad}$, between said first YBCO radiating means and said second YBCO radiating means;

said radiation impedance, $Z_{rad}$, prevents said current flow between said first YBCO radiating means, said second YBCO radiating means and the ground; and said first YBCO radiating means and second YBCO radiation means preventing said micro-antenna from coupling with a plurality of surrounding objects.

12. The multi-resonant double-sided spiral HTS magnetic dipole micro-antenna, as recited in claim 11, further comprising said LAO substrate being constructed of a single $LaAlO_3$ crystal with a loss-tangent of tan $\delta \approx 10^{-5}$.

13. The multi-resonant double-sided spiral HTS magnetic dipole micro-antenna, as recited in claim 12, further comprising said single $LaAlO_3$ crystal having a dielectric constant of about 24.

14. The multi-resonant double-sided spiral HTS magnetic dipole micro-antenna, as recited in claim 13, further comprising said first YBCO radiating means having a $T_c$ of about 92 Kelvin.

15. The multi-resonant double-sided spiral HTS magnetic dipole micro-antenna, as recited in claim 14, further comprising said second YBCO radiating means having a $T_c$ of about 92 Kelvin.

16. The multi-resonant double-sided HTS magnetic dipole micro-antenna, as recited in claim 15, further comprising said first curvilinear shape being a first spiral.

17. The multi-resonant double-sided HTS magnetic dipole micro-antenna, as recited in claim 16, further comprising said second curvilinear shape being a second spiral.

18. The multi-resonant double-sided HTS magnetic dipole micro-antenna, as recited in claim 16, further comprising said first spiral being a multiple-turn Archimedean spiral.

19. The multi-resonant double-sided HTS magnetic dipole micro-antenna, as recited in claim 17, further comprising said second spiral being said multiple-turn Archimedean spiral.

20. The multi-resonant double-sided HTS magnetic dipole micro-antenna, as recited in claim 15, further comprising said first curvilinear shape being a first plurality of concentric rings.

21. The multi-resonant double-sided HTS magnetic dipole micro-antenna, as recited in claim 20, further comprising said first plurality of concentric rings being arranged into a plurality of top ring clusters.

22. The multi-resonant double-sided HTS magnetic dipole micro-antenna, as recited in claim 21, further comprising each of said plurality of top ring clusters being separated by a top cluster gap.

23. The multi-resonant double-sided HTS magnetic dipole micro-antenna, as recited in claim 22, further comprising each of said first plurality of concentric rings being separated by a top ring gap.

24. The multi-resonant double-sided HTS magnetic dipole micro-antenna, as recited in claim 20, further comprising said second curvilinear shape being a second plurality of concentric rings.

25. The multi-resonant double-sided HTS magnetic dipole micro-antenna, as recited in claim 24, further comprising said second plurality of concentric rings being arranged into a plurality of bottom ring clusters.

26. The multi-resonant double-sided HTS magnetic dipole micro-antenna, as recited in claim 25, further comprising each of said plurality of bottom ring clusters being separated by a bottom cluster gap.

27. The multi-resonant double-sided HTS magnetic dipole micro-antenna, as recited in claim 26, further comprising each of said second plurality of concentric rings being separated by a bottom ring gap.

28. A multi-resonant double-sided spiral HTS magnetic dipole micro-antenna, comprising:

a first YBCO thin-film is patterned into a first plurality of spiral loops to provide a first means for YBCO radiation on a top surface of an LAO substrate;

a second YBCO thin-film is patterned into a second plurality of spiral loops to provide a second means for YBCO radiation on a bottom surface of said LAO substrate;

said first YBCO radiating means generating a first magnetic flux;

said second YBCO radiation means generating a second magnetic flux;

said first YBCO radiating means and said second YBCO radiating means generating an inductive coupling by a magnetic dipole moment;

said first YBCO radiating means being configured so that at any one of a plurality half-cycles a first current flow is in phase with a second current flow in said second YBCO radiating means;

said first plurality of spiral loops and said second plurality of spiral loops each generate a circular polarization radiation pattern;

a discontinuity between said first YBCO radiation means and said second YBCO radiation means causes a plurality of multi-resonant properties;

said first YBCO radiation means, said second YBCO radiation means and said LAO substrate provide a decreased surface impedance; and said inductive coupling, said first current flow and said second current flow being in phase, said decreased surface impedance, said circular polarization radiation pattern and said plurality of multi-resonant properties permit a reduced antenna size with an increased antenna efficiency.

29. The multi-resonant double-sided spiral HTS magnetic dipole micro-antenna, as recited in claim 28, further comprising said first YBCO thin-film being deposited to pattern said first plurality of spiral loops.

30. The multi-resonant double-sided spiral HTS magnetic dipole micro-antenna, as recited in claim 29, further comprising said second YBCO thin-film being deposited to pattern said second plurality of spiral loops.

31. The multi-resonant double-sided spiral HTS magnetic dipole micro-antenna, as recited in claim 30, further comprising said second YBCO radiating means being configured so that at any one of the plurality of half-cycles said second current flow is in phase with said first current flow in said first YBCO radiating means.

32. The multi-resonant double-sided spiral HTS magnetic dipole micro-antenna, as recited in claim 31, further comprising said first magnetic flux being generated within said first plurality of spiral loops.

33. The multi-resonant double-sided spiral HTS magnetic dipole micro-antenna, as recited in claim 32, further comprising and said second magnetic flux being generated within said second plurality of spiral loops.

34. The multi-resonant double-sided spiral HTS magnetic dipole micro-antenna, as recited in claim 33, further comprising said magnetic dipole moment having a given magnitude.

35. The multi-resonant double-sided spiral HTS magnetic dipole micro-antenna, as recited in claim 34, further comprising said given magnitude being proportional to said first magnetic flux.

36. The multi-resonant double-sided spiral HTS magnetic dipole micro-antenna, as recited in claim 35, further comprising said given magnitude being proportional to said second magnetic flux.

37. The multi-resonant double-sided spiral HTS magnetic dipole micro-antenna, as recited in claim 36, further comprising said decreased surface impedance being a superconductive property based on a temperature-dependent London penetration depth.

38. The multi-resonant double-sided spiral HTS magnetic dipole micro-antenna, as recited in claim 37, further comprising:

a voltage at any one of the plurality of half-cycles of said first YBCO radiating means results in a current flow in said second YBCO radiating means forming a radiation impedance, $Z_{rad}$, between said first YBCO radiating means and said second YBCO radiating means;

said radiation impedance, $Z_{rad}$, prevents said current flow between said first YBCO radiating means, said second YBCO radiating means and the ground; and said first YBCO radiating means and second YBCO radiation means preventing said micro-antenna from coupling with a plurality of surrounding objects.

39. The multi-resonant double-sided spiral HTS magnetic dipole micro-antenna, as recited in claim 38, further comprising said LAO substrate being constructed of a single $LaAlO_3$ crystal with a loss-tangent of tan $\delta \approx 10^{-5}$.

40. The multi-resonant double-sided spiral HTS magnetic dipole micro-antenna, as recited in claim 39, further comprising said single $LaAlO_3$ crystal having a dielectric constant of about 24.

41. The multi-resonant double-sided spiral HTS magnetic dipole micro-antenna, as recited in claim 40, further comprising said first YBCO radiating means having a $T_c$ of about 92 Kelvin.

42. The multi-resonant double-sided spiral HTS magnetic dipole micro-antenna, as recited in claim 41, further comprising said second YBCO radiating means having a $T_c$ of about 92 Kelvin.

43. The multi-resonant double-sided spiral HTS magnetic dipole micro-antenna, as recited in claim 42, further comprising said first YBCO radiating means being shaped into a multiple-turn Archimedean spiral.

44. The multi-resonant double-sided spiral HTS magnetic dipole micro-antenna, as recited in claim 43, further comprising said second YBCO radiating means being shaped into a multiple-turn Archimedean spiral.

45. A multi-resonant double-sided folded log-periodic HTS magnetic dipole micro-antenna, comprising:

a first YBCO thin-film is patterned into a first plurality of concentric rings to provide a first means for YBCO radiation on a top surface of an LAO substrate;

a second YBCO thin-film is patterned in a second plurality of concentric rings to provide a second means for YBCO radiation on a bottom surface of said LAO substrate;

said first YBCO radiating means generating a first magnetic flux;

said second YBCO radiation means generating a second magnetic flux;

said first YBCO radiation means and said second YBCO radiation means generating an inductive coupling by a magnetic dipole moment;

said first YBCO radiating means being configured so that at any one of a plurality half-cycles a first current flow is in phase with a second current flow in said second YBCO radiating means;

said first plurality of concentric rings and said second plurality of concentric rings each generate a circular polarization radiation pattern;

a discontinuity between said first YBCO radiation means and said second YBCO radiation means causes a plurality of multi-resonant properties;

said first YBCO radiation means, said second YBCO radiation means and said LAO substrate provide a decreased surface impedance; and said inductive coupling, said first current flow and said second current flow being in phase, said decreased surface impedance, said circular polarization radiation pattern and said plurality of multi-resonant properties permit a reduced antenna size with an increased antenna efficiency.

46. The multi-resonant double-sided folded log-periodic HTS magnetic dipole micro-antenna, as recited in claim 45, further comprising said first YBCO thin-film being deposited to pattern said first plurality of concentric rings.

47. The multi-resonant double-sided folded log-periodic HTS magnetic dipole micro-antenna, as recited in claim 46, further comprising said second YBCO thin-film being deposited to pattern said second plurality of concentric rings.

48. The multi-resonant double-sided folded log-periodic HTS magnetic dipole micro-antenna, as recited in claim 47, further comprising said second YBCO radiating means being configured so that at any one of the plurality of half-cycles said second current flow is in phase with said first current flow in said first YBCO radiating means.

49. The multi-resonant double-sided folded log-periodic HTS magnetic dipole micro-antenna, as recited in claim 48, further comprising said first magnetic flux being generated within said first plurality of concentric rings.

50. The multi-resonant double-sided folded log-periodic HTS magnetic dipole micro-antenna, as recited in claim 49, further comprising and said second magnetic flux being generated within said second plurality of concentric rings.

51. The multi-resonant double-sided folded log-periodic HTS magnetic dipole micro-antenna, as recited in claim 50, further comprising said magnetic dipole moment having a given magnitude.

52. The multi-resonant double-sided folded log-periodic HTS magnetic dipole micro-antenna, as recited in claim 51, further comprising said given magnitude being proportional to said first magnetic flux.

53. The multi-resonant double-sided folded log-periodic HTS magnetic dipole micro-antenna, as recited in claim 52, further comprising said given magnitude being proportional to said second magnetic flux.

54. The multi-resonant double-sided folded log-periodic HTS magnetic dipole micro-antenna, as recited in claim 53, further comprising said decreased surface impedance being a superconductive property based on a temperature-dependent London penetration depth.

55. The multi-resonant double-sided folded log-periodic HTS magnetic dipole micro-antenna, as recited in claim 54, further comprising:

a voltage at any one of the plurality of half-cycles of said first YBCO radiating means results in a current flow in said second YBCO radiating means forming a radiation impedance, $Z_{rad}$, between said first YBCO radiating means and said second YBCO radiating means;

said radiation impedance, $Z_{rad}$, prevents said current flow between said first YBCO radiating means, said second YBCO radiating means and the ground; and said first YBCO radiating means and second YBCO radiation means preventing said micro-antenna from coupling with a plurality of surrounding objects.

56. The multi-resonant double-sided folded log-periodic HTS magnetic dipole micro-antenna, as recited in claim 54, further comprising said LAO substrate being constructed of a single $LaAlO_3$ crystal with a loss-tangent of tan $\delta \approx 10^{-5}$.

57. The multi-resonant double-sided folded log-periodic HTS magnetic dipole micro-antenna, as recited in claim 56, further comprising said single $LaAlO_3$ crystal having a dielectric constant of about 24.

58. The multi-resonant double-sided folded log-periodic HTS magnetic dipole micro-antenna, as recited in claim 57, further comprising said first YBCO radiating means having a $T_c$ of about 92 Kelvin.

59. The multi-resonant double-sided folded log-periodic HTS magnetic dipole micro-antenna, as recited in claim 58, further comprising said second YBCO radiating means having a $T_c$ of about 92 Kelvin.

60. The multi-resonant double-sided folded log-periodic HTS magnetic dipole micro-antenna, as recited in claim 59, further comprising said first plurality of concentric rings being arranged into a plurality of top ring clusters.

61. The multi-resonant double-sided folded log-periodic HTS magnetic dipole micro-antenna, as recited in claim 60, further comprising each of said plurality of top ring clusters being separated by a top cluster gap.

62. The multi-resonant double-sided folded log-periodic HTS magnetic dipole micro-antenna, as recited in claim 61, further comprising each of said first plurality of concentric rings being separated by a top ring gap.

63. The multi-resonant double-sided folded log-periodic HTS magnetic dipole micro-antenna, as recited in claim 62, further comprising said second plurality of concentric rings being arranged into a plurality of bottom ring clusters.

64. The multi-resonant double-sided folded log-periodic HTS magnetic dipole micro-antenna, as recited in claim 63, further comprising each of said plurality of bottom ring clusters being separated by a bottom cluster gap.

65. The multi-resonant double-sided folded log-periodic HTS magnetic dipole micro-antenna, as recited in claim 64, further comprising each of said second plurality of concentric rings being separated by a bottom ring gap.

66. A method for reducing antenna length with a multi-resonant double-sided HTS magnetic dipole micro-antenna, comprising the steps of:

depositing a first YBCO thin-film on a top surface of an LAO substrate;

depositing a second YBCO thin-film on a bottom surface of said LAO substrate;

forming a first means for YBCO radiation by patterning said first YBCO thin-film on said top surface into a first curvilinear shape;

forming a second means for YBCO radiation by patterning said second YBCO thin-film on said bottom surface in a second curvilinear shape;

generating a first magnetic flux within said first YBCO radiating means;

generating a second magnetic flux within said second YBCO radiation means;

generating an inductive coupling by a magnetic dipole moment from said first YBCO radiation means and said second YBCO radiation means;

configuring said first YBCO radiating means so that at any one of a plurality half-cycles a first current flow is in phase with a second current flow in said second YBCO radiating means;

generating a circular polarization radiation pattern in said first curvilinear shape and said second curvilinear shape;

causing a plurality of multi-resonant properties by a discontinuity between said first YBCO radiation means and said second YBCO radiation means;

providing a decreased surface impedance due to the interaction of said first YBCO radiating means, said second YBCO radiating means and said LAO substrate; and permitting a reduced antenna size with an increased antenna efficiency due to said inductive coupling, said first current flow and said second current flow being in phase, said decreased surface impedance, said circular polarization radiation pattern and said plurality of multi-resonant properties.

67. The method for reducing antenna length with a multi-resonant double-sided HTS magnetic dipole micro-antenna, as recited in claim 66, further comprising the step of configuring said second YBCO radiating means so that at any one of the plurality of half-cycles said second current flow is in phase with said first current flow in said first YBCO radiating means.

68. The method for reducing antenna length with a multi-resonant double-sided HTS magnetic dipole micro-antenna, as recited in claim 67, further comprising the step of generating said first magnetic flux within said first curvilinear shape.

69. The method for reducing antenna length with a multi-resonant double-sided HTS magnetic dipole micro-antenna, as recited in claim 68, further comprising the step of generating and said second magnetic flux within said second curvilinear shape.

70. The method for reducing antenna length with a multi-resonant double-sided HTS magnetic dipole micro-antenna, as recited in claim 69, further comprising the step of providing said magnetic dipole moment with a given magnitude.

71. The method for reducing antenna length with a multi-resonant double-sided HTS magnetic dipole micro-antenna, as recited in claim 70, further comprising the step of providing said given magnitude as proportional to said first magnetic flux.

72. The method for reducing antenna length with a multi-resonant double-sided HTS magnetic dipole micro-antenna, as recited in claim 71, further comprising the step of providing said given magnitude as proportional to said second magnetic flux.

73. The method for reducing antenna length with a multi-resonant double-sided HTS magnetic dipole micro-antenna, as recited in claim 72, wherein said decreased surface impedance is a superconductive property based on a temperature-dependent London penetration depth.

74. The method for reducing antenna length with a multi-resonant double-sided HTS magnetic dipole micro-antenna, as recited in claim 73, further comprising the steps of:

forming a radiation impedance, $Z_{rad}$, between said first YBCO radiating means and said second YBCO radiating means when a voltage at any one of the plurality of half-cycles of said first YBCO radiating means results in a current flow in said second YBCO radiating means;

said radiation impedance, $Z_{rad}$, preventing said current flow between said first YBCO radiating means, said second YBCO radiating means and the ground; and said first YBCO radiating means and second YBCO radiation means preventing said micro-antenna from coupling with a plurality of surrounding objects.

75. The method for reducing antenna length with a multi-resonant double-sided HTS magnetic dipole micro-antenna, as recited in claim 74, further comprising the step of constructing said LAO substrate from a single $LaAlO_3$ crystal with a loss-tangent of tan $\delta \approx 10^{-5}$.

76. The method for reducing antenna length with a multi-resonant double-sided HTS magnetic dipole micro-antenna, as recited in claim 75, further comprising the step of forming said single $LaAlO_3$ crystal with a dielectric constant of about 24.

77. The method for reducing antenna length with a multi-resonant double-sided HTS magnetic dipole micro-antenna, as recited in claim 76, further comprising the step of providing said first YBCO radiating means with a $T_c$ of about 92 Kelvin.

78. The method for reducing antenna length with a multi-resonant double-sided HTS magnetic dipole micro-antenna, as recited in claim 77, further comprising the step of providing said second YBCO radiating means with a $T_c$ of about 92 Kelvin.

79. The method for reducing antenna length with a multi-resonant double-sided HTS magnetic dipole micro-antenna, as recited in claim 78, further comprising the step of forming said first curvilinear shape into a first spiral.

80. The method for reducing antenna length with a multi-resonant double-sided HTS magnetic dipole micro-antenna, as recited in claim 79, further comprising the step of forming said second curvilinear shape into a second spiral.

81. The method for reducing antenna length with a multi-resonant double-sided HTS magnetic dipole micro-antenna, as recited in claim 79, further comprising the step of forming said first spiral into a multiple-turn Archimedean spiral.

82. The method for reducing antenna length with a multi-resonant double-sided HTS magnetic dipole micro-antenna, as recited in claim 80, further comprising the step of forming said second spiral into a multiple-turn Archimedean spiral.

83. The method for reducing antenna length with a multi-resonant double-sided HTS magnetic dipole micro-antenna, as recited in claim 78, further comprising the step of forming said first curvilinear shape into a first plurality of concentric rings.

84. The method for reducing antenna length with a multi-resonant double-sided HTS magnetic dipole micro-antenna, as recited in claim 83, further comprising the step of arranging said first plurality of concentric rings into a plurality of top ring clusters.

85. The method for reducing antenna length with a multi-resonant double-sided HTS magnetic dipole micro-antenna, as recited in claim 84, further comprising the step of separating each of said plurality of top ring clusters with a top cluster gap.

86. The method for reducing antenna length with a multi-resonant double-sided HTS magnetic dipole micro-antenna, as recited in claim 85, farther comprising the step of separating each of said first plurality of concentric rings with a top ring gap.

87. The method for reducing antenna length with a multi-resonant double-sided HTS magnetic dipole micro-antenna, as recited in claim 83, further comprising the step of forming said second curvilinear shape into a second plurality of concentric rings.

88. The method for reducing antenna length with a multi-resonant double-sided HTS magnetic dipole micro-antenna, as recited in claim 87, further comprising the step of arranging said second plurality of concentric rings into a plurality of bottom ring clusters.

89. The method for reducing antenna length with a multi-resonant double-sided HTS magnetic dipole micro-antenna, as recited in claim 88, further comprising the step of separating each of said plurality of bottom ring clusters with a bottom cluster gap.

90. The method for reducing antenna length with a multi-resonant double-sided HTS magnetic dipole micro-antenna, as recited in claim 89, further comprising the step of separating each of said second plurality of concentric rings being with a bottom ring gap.

* * * * *